US012226012B1

(12) United States Patent
Newell

(10) Patent No.: US 12,226,012 B1
(45) Date of Patent: Feb. 18, 2025

(54) CHIP RACK

(71) Applicant: Bobbi Newell, New River, AZ (US)

(72) Inventor: Bobbi Newell, New River, AZ (US)

( * ) Notice: Subject to any disclaimer, the term of this patent is extended or adjusted under 35 U.S.C. 154(b) by 22 days.

(21) Appl. No.: 18/126,790

(22) Filed: Mar. 27, 2023

(51) Int. Cl.

| | |
|---|---|
| ***A47B 77/04*** | (2006.01) |
| ***A47F 1/12*** | (2006.01) |
| *A47F 1/04* | (2006.01) |
| *A47F 5/00* | (2006.01) |
| *A47F 5/08* | (2006.01) |

(52) U.S. Cl.
CPC ..... *A47B 77/04* (2013.01); *A47F 1/12* (2013.01); *A47F 1/04* (2013.01); *A47F 5/0006* (2013.01); *A47F 2005/0012* (2013.01); *A47F 5/0838* (2013.01); *A47F 5/0884* (2013.01); *A47G 2400/06* (2013.01)

(58) Field of Classification Search
CPC .... A47B 77/04; A47B 75/00; A47G 2400/06; A47F 5/08; A47F 5/0006; A47F 5/0807; A47F 5/0838; A47F 1/12; A47F 1/04; A47F 1/00; A47F 7/143; A47F 1/128; A47F 5/0884; A47F 2005/0012
USPC ..... 211/85.4, 59.1, 59.2, 12, 57.1, 113, 211/119.003, 94.01, 85.29, 124; 312/246, 312/334.23; 248/307, 323
See application file for complete search history.

(56) References Cited

U.S. PATENT DOCUMENTS

| | | | | | |
|---|---|---|---|---|---|
| 699,971 | A * | 5/1902 | Poschmann | A47H 15/04 | 211/124 |
| 869,233 | A * | 10/1907 | Drucker | A47G 25/746 | 211/85.3 |
| 1,093,232 | A * | 4/1914 | Wolf | A47G 25/746 | 211/124 |
| 1,132,190 | A * | 3/1915 | Kohout | A47G 25/746 | 211/85.3 |
| 1,937,646 | A * | 12/1933 | Fletcher | D06F 57/00 | 211/89.01 |
| 2,271,941 | A * | 2/1942 | Kemmitt | A47G 25/24 | 211/90.03 |
| 2,532,022 | A * | 11/1950 | Gunderson | A47F 5/0884 | 211/124 |
| 2,580,961 | A * | 1/1952 | Schmedinghoff | A47K 1/09 | 211/119.003 |
| 2,598,614 | A * | 5/1952 | Gilbert | A47G 25/743 | 211/89.01 |
| 2,604,997 | A * | 7/1952 | Pearson | A47F 3/063 | 211/94.01 |

(Continued)

*Primary Examiner* — Devin K Barnett
(74) *Attorney, Agent, or Firm* — Cramer Patent & Design PLLC; Aaron R. Cramer

(57) ABSTRACT

A chip rack is a sliding rack capable of retaining a plurality of chip bag clips secured to chip bags within the rack. The chip rack includes a shelf mount with an undershelf armature, a slide carrier, and an end armature, as well as a shelf that is coupled to the mount. The rack also features a slide that extends forward from the shelf mount, providing easy access to a plurality of bagged food items. The slide is equipped with a plurality of bag clips that securely hold the bags closed, preventing air and moisture from affecting the contents. The design of the rack allows for optimal use of storage space and easy organization of bagged food items, making it an ideal solution for individuals or businesses looking to maintain the freshness and organization of their snacks.

3 Claims, 10 Drawing Sheets

(56) References Cited

U.S. PATENT DOCUMENTS 2,606,666 A * 8/1952 Gray ..... A47J 47/16 211/113
2,626,713 A * 8/1952 Peacock ..... A47G 25/485 24/328
3,124,253 A * 3/1964 Petrich ..... A47G 25/746 211/94.01
3,252,583 A * 5/1966 Walther ..... A47B 81/04 248/303
3,297,290 A * 1/1967 Patterson ..... A47F 5/0068 248/302
3,343,683 A * 9/1967 Wheeler ..... B63B 27/36 211/124
3,730,355 A * 5/1973 Feldman ..... A47F 5/0876 211/90.01
3,741,131 A * 6/1973 Leadbetter ..... A47B 5/02 108/97
3,897,122 A * 7/1975 McEvers ..... A47G 25/746 211/85.3
3,967,346 A * 7/1976 Young, Jr. ..... A47F 5/0884 211/89.01
4,019,638 A * 4/1977 Miller ..... A47F 5/0025 211/74
4,039,082 A * 8/1977 Ladinsky ..... A47B 63/00 108/26
4,261,121 A 4/1981 Coon
4,282,630 A * 8/1981 Toder ..... A47H 15/04 206/343
4,367,818 A * 1/1983 Suttles ..... A47F 7/28 211/74
4,461,387 A * 7/1984 Belokin, Jr. ..... F16B 2/245 403/379.5
4,474,300 A * 10/1984 Entis ..... A47F 5/0823 211/57.1
D277,436 S * 2/1985 Benedict ..... D6/315
4,673,089 A * 6/1987 Chap ..... A47G 23/0208 211/119
4,713,899 A * 12/1987 Fast ..... G09F 3/20 248/205.3
4,869,379 A * 9/1989 Hawkrige ..... A47B 61/02 211/171
4,907,706 A * 3/1990 Henderson ..... A47F 7/0042 211/113
5,054,168 A 10/1991 Gandy et al.
D334,291 S * 3/1993 Rooke ..... D6/315
5,231,779 A * 8/1993 Valiulis ..... A47F 5/0869 40/649
5,457,858 A 10/1995 Lin
D364,280 S * 11/1995 Maynard ..... D6/326
5,531,417 A * 7/1996 Valiulis ..... A47F 5/0869 248/309.2
5,655,672 A * 8/1997 Stuchlik, III ..... A47G 21/14 248/37.3
5,671,987 A * 9/1997 Hommes ..... A47B 88/42 312/234.5
5,802,677 A 9/1998 Dorman et al.
6,360,901 B1 * 3/2002 Parham ..... A47F 7/285 211/49.1
6,530,488 B1 * 3/2003 Krammes, Jr. ..... A01K 97/06 211/85.15
6,631,812 B2 * 10/2003 Ruiz ..... A47G 23/0208 211/74
6,648,153 B2 * 11/2003 Holmes ..... G06Q 10/087 211/85.15
6,763,953 B1 * 7/2004 Pobee-Mensah .. G11B 33/0472 211/124
6,863,196 B1 * 3/2005 Carter ..... A47G 25/10 211/30
6,976,595 B1 * 12/2005 Geller ..... A47F 5/0838 211/124
7,178,678 B2 * 2/2007 Mansfield ..... A47F 5/0861 248/221.11
7,219,806 B1 * 5/2007 Morrow ..... A47F 5/0869 211/59.1
7,284,303 B2 10/2007 Canegallo et al.
7,395,937 B2 * 7/2008 Sliwowski ..... A47F 5/0884 211/106.01
7,490,424 B2 * 2/2009 Caterinacci ..... G09F 7/20 40/606.14
7,641,061 B1 * 1/2010 Cuzzocrea ..... A47F 5/083 211/113
7,703,308 B2 * 4/2010 Nagelski ..... A47F 5/0861 70/57.1
8,157,224 B2 4/2012 Turvey et al.
8,308,119 B2 * 11/2012 Foltz ..... A47F 5/0006 248/314
9,022,237 B2 * 5/2015 Hall ..... A47B 81/04 211/162
9,659,510 B2 5/2017 Myoung
9,820,617 B1 * 11/2017 Utter ..... A47F 13/085
10,334,975 B2 7/2019 Utter
10,986,942 B2 * 4/2021 Wood ..... A47F 7/022
2004/0026344 A1 * 2/2004 Sedon ..... A47F 5/0861 211/59.1
2005/0023235 A1 * 2/2005 Rodriguez ..... A47F 5/0884 211/85.15
2006/0163183 A1 * 7/2006 Iwasaki ..... B65D 73/0028 211/113
2007/0102379 A1 * 5/2007 Strand ..... A47F 5/0823 211/59.1
2008/0245753 A1 * 10/2008 Spriegel ..... B25H 3/04 211/13.1
2009/0032482 A1 * 2/2009 Battaglia ..... A47F 5/0823 211/59.1
2009/0223916 A1 * 9/2009 Kahl ..... A47F 1/12 211/85.4
2010/0169190 A1 * 7/2010 Allison ..... G06Q 10/087 705/28
2011/0215061 A1 * 9/2011 Niederhuefner ..... A47F 1/128 211/59.3
2012/0138551 A1 * 6/2012 Gelardi ..... A47F 13/085 211/59.2
2013/0008863 A1 * 1/2013 Valiulis ..... A47F 1/128 29/428
2013/0306817 A1 * 11/2013 Smed ..... F16M 13/022 248/323
2014/0263110 A1 * 9/2014 Erickson ..... A47G 25/10 211/32
2016/0106208 A1 * 4/2016 Kirkpatrick ..... A47F 5/0892 211/85.4

* cited by examiner

CHIP RACK

RELATED APPLICATIONS

None.

FIELD OF THE INVENTION

The present invention relates generally to a storage device for bagged items and more specifically to a rack for the storage of chips.

BACKGROUND OF THE INVENTION

In today's fast-paced world, snacking on chips has become a common indulgence for people of all ages. Whether it's at home, work, or on the go, chips are a convenient and tasty way to satisfy cravings. However, keeping chips fresh and organized can be a challenge, especially when storing large quantities. Additionally, multiple opened chip bags often present an unappealing and disorganized pantry view. The development of the Chip Rack addresses these concerns in a manner that is efficient and cost effective.

SUMMARY OF THE INVENTION

To achieve the above and other objectives, the present invention provides for a chip rack has a shelf mount having an undershelf armature, a slide carrier, and an end armature, a shelf coupled to the shelf mount, a slide extending forward from the shelf mount to provide access to a plurality of bagged food items, and a plurality of bag clips coupled to the slide and the bag clips hold the bagged food items closed.

The shelf mount may include an overshelf armature that presses against a top side of the shelf. The undershelf armature, the overshelf armature, the slide carrier, and the slide may be generally rectangular in shape. The overshelf armature may be positioned above and parallel to the undershelf armature. The overshelf armature and the undershelf armature may grip the shelf in order to support the slide carrier. The undershelf armature may press against a bottom side of the shelf. The slide carrier may be positioned under and parallel to the undershelf armature.

The end armature may couple the undershelf armature to the slide carrier at a front of the shelf mount. The slide carrier may guide and retain the slide as the slide moves between a retracted position and an extended position and the clip slot provides clearance for the bag clips that are coupled to the slide as the bag clips move through the front of the shelf mount. A front of the undershelf armature may be coupled to the end armature that extends downward from the undershelf armature and couples with a front of the slide carrier. The slide carrier may include a clip slot that is longitudinally oriented on the slide carrier and opens to the front of the slide carrier.

The end armature may include a clip aperture which may provide further clearance for the bag clips. The shelf mount may couple to the shelf such that the undershelf armature is positioned beneath the shelf. A plurality of mounting hardware may be used to secure the shelf mount to the shelf. The slide may be aligned with the slide carrier and is slidably coupled to the top of the slide carrier.

The bagged food items may be selected from the group consisting of one or more bags of potato chips, one or more bags of cereal, one or more bags of crackers, or any combination thereof. The bag clips may be coupled to the slide such that the bag clips pass vertically through a central aperture of the slide. The bag clips may store the bagged food items beneath the slide. The bag clips may be equally spaced along the slide and are aligned such that each of the bag clips are squeezed by applying front to rear pressure. Each of the bag clips may include a front paddle, a rear paddle, and a spring.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
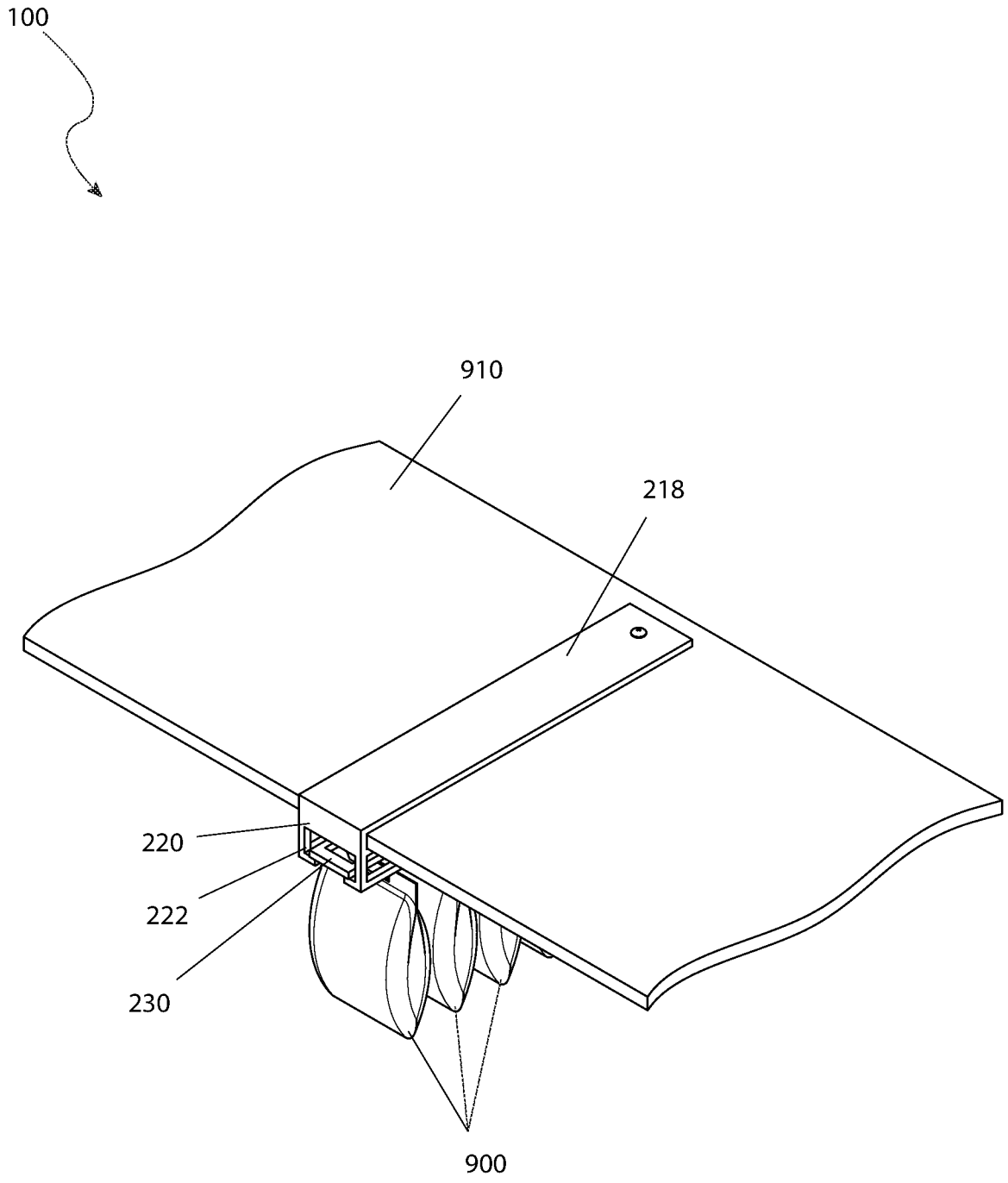
FIG. 1 is a top front isometric view of a chip rack, according to an embodiment of the present invention, illustrating the retracted position.
Figure 2:
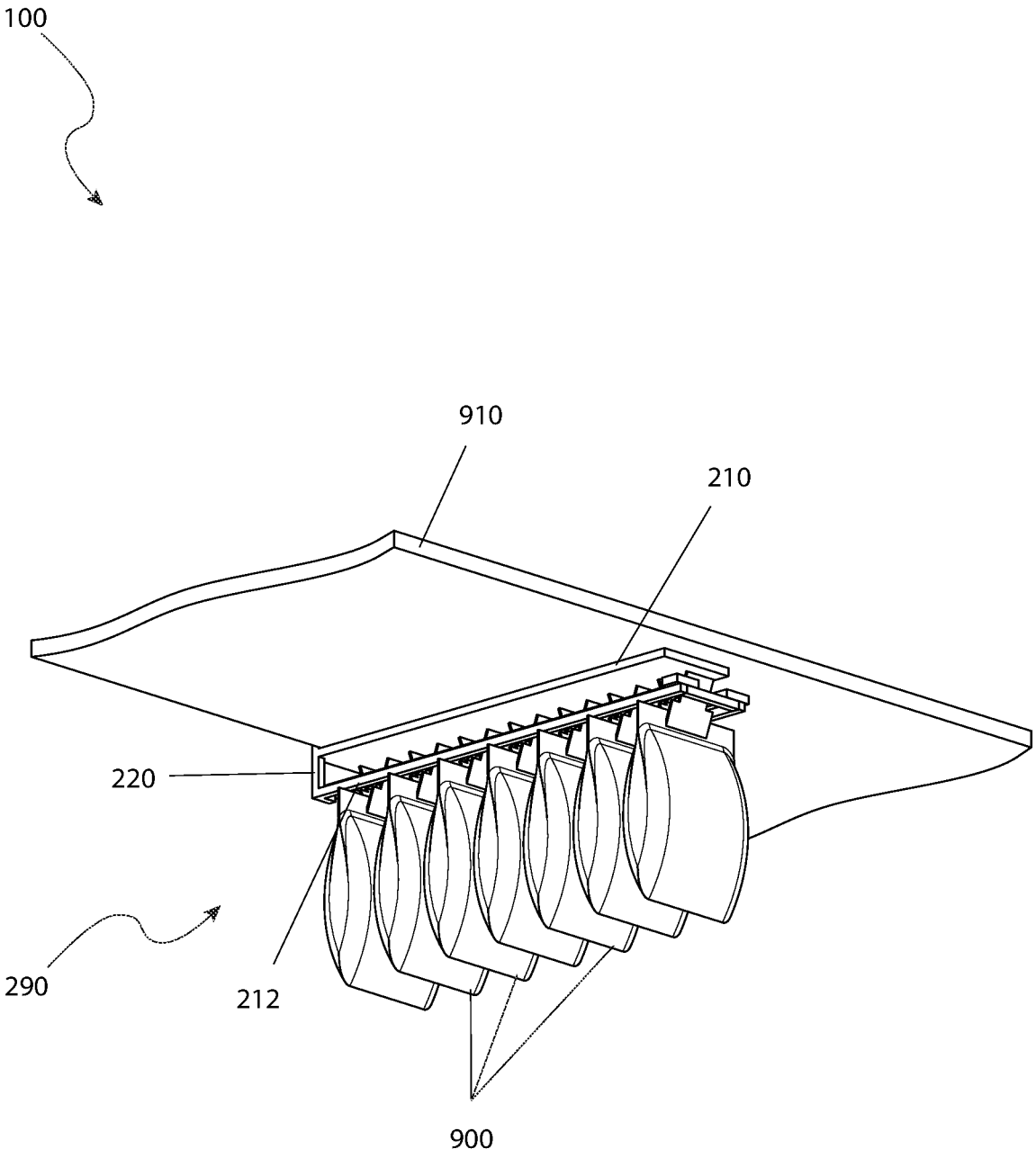
FIG. 2 is a bottom rear isometric view of a chip rack, according to an embodiment of the present invention, illustrating the retracted position.
Figure 3:
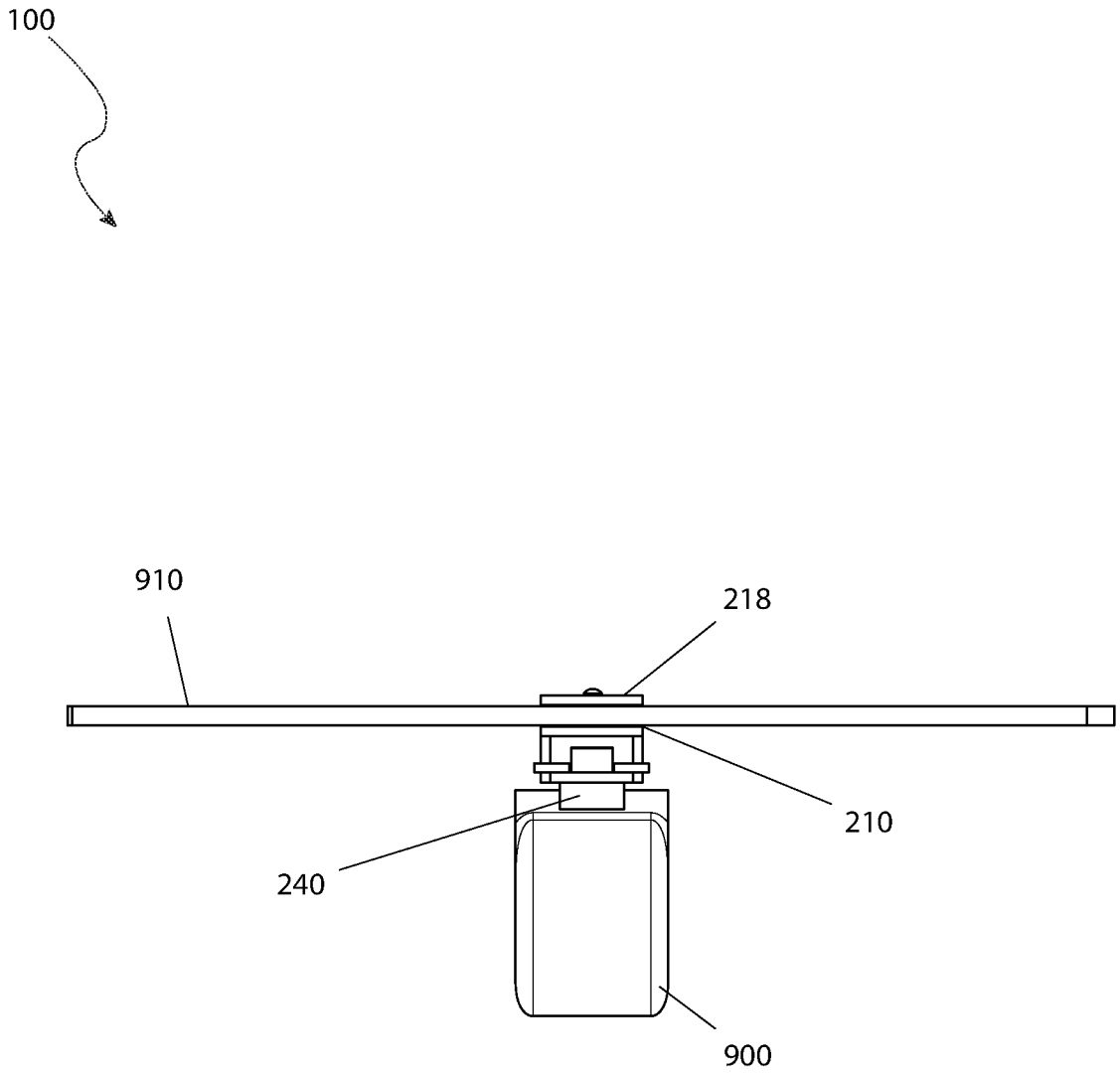
FIG. 3 is a rear view of a chip rack, according to an embodiment of the present invention.
Figure 4:
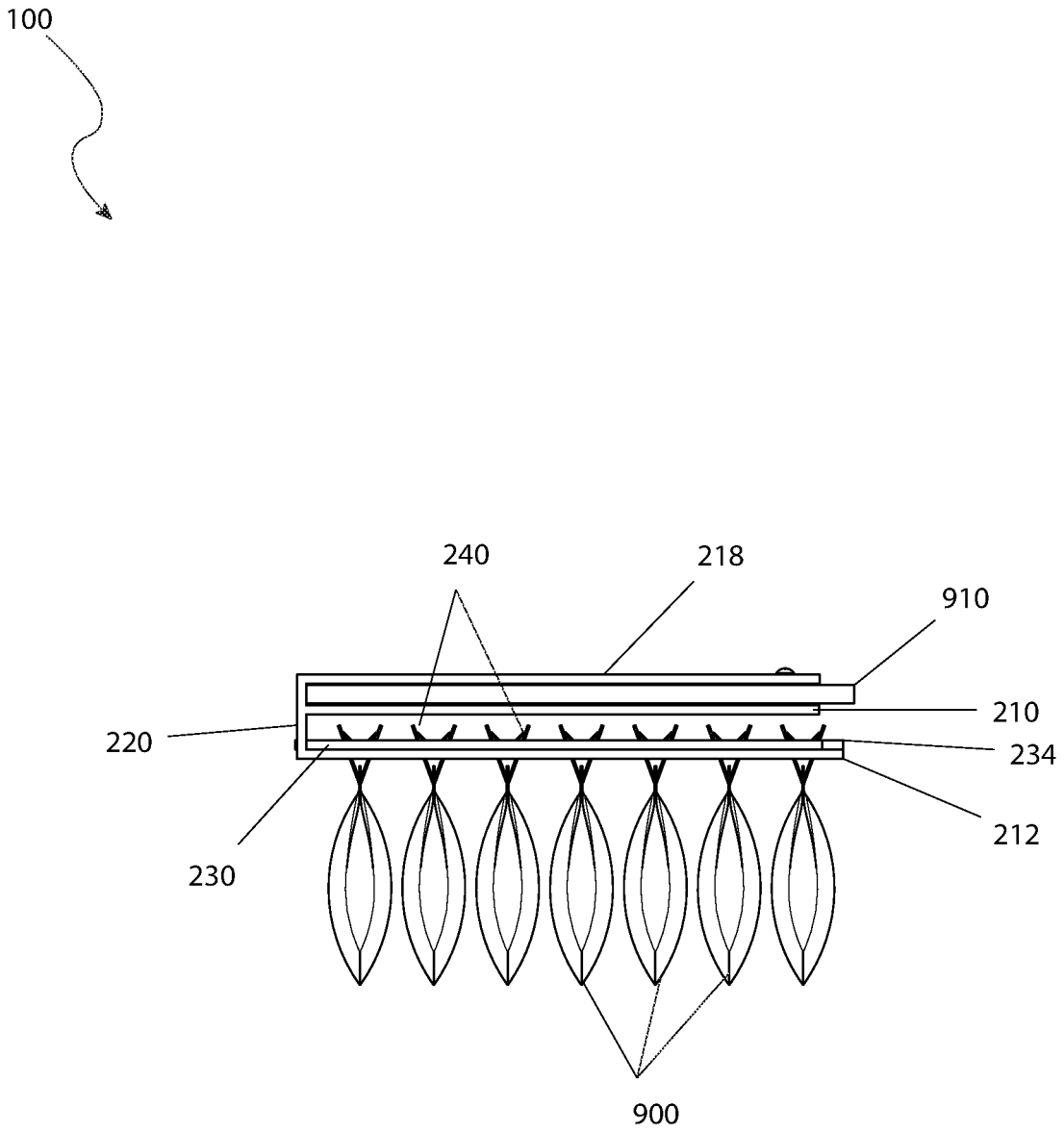
FIG. 4 is a side view of a chip rack, according to an embodiment of the present invention.
Figure 5:
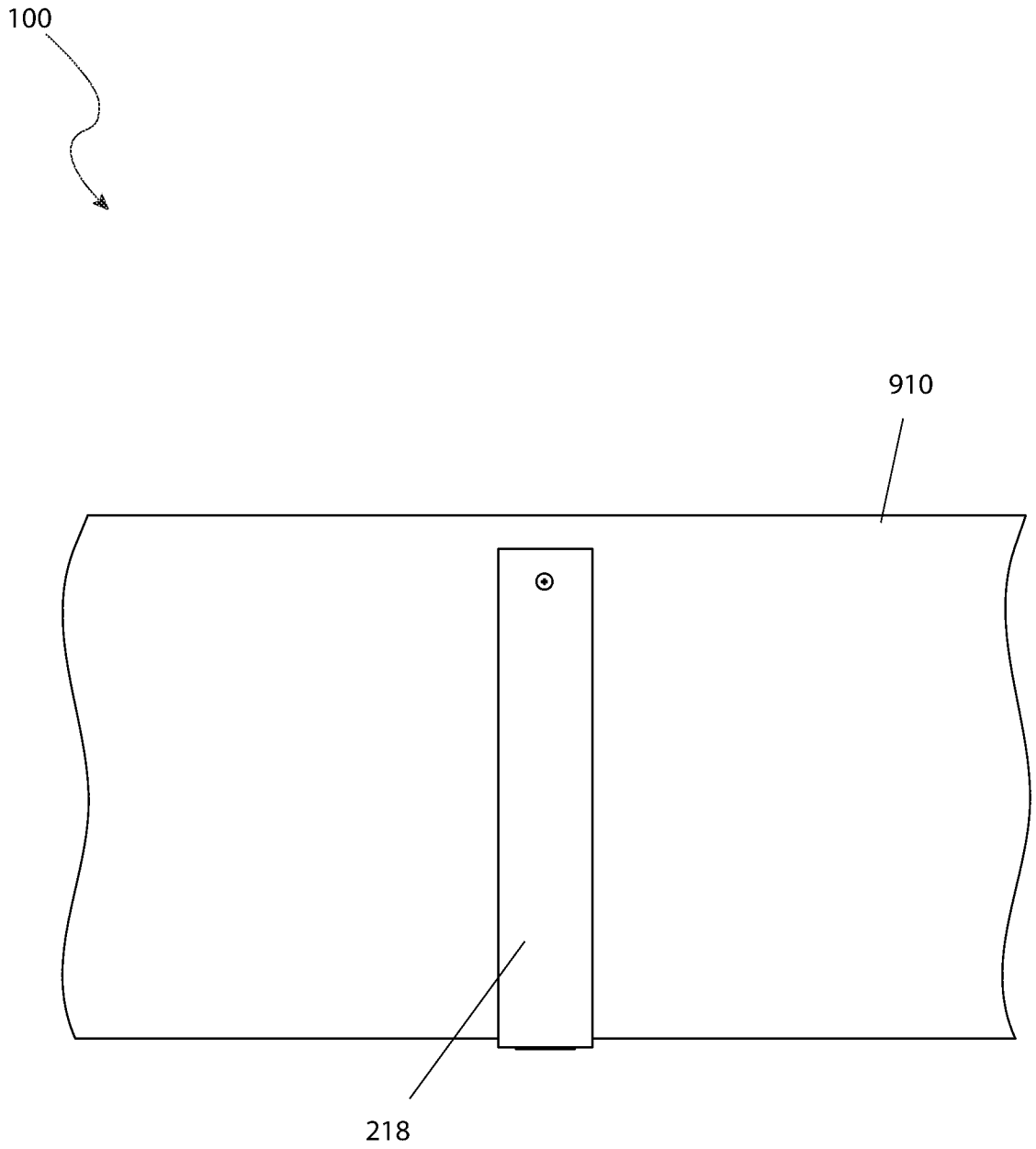
FIG. 5 is a top view of a chip rack, according to an embodiment of the present invention.
Figure 6:
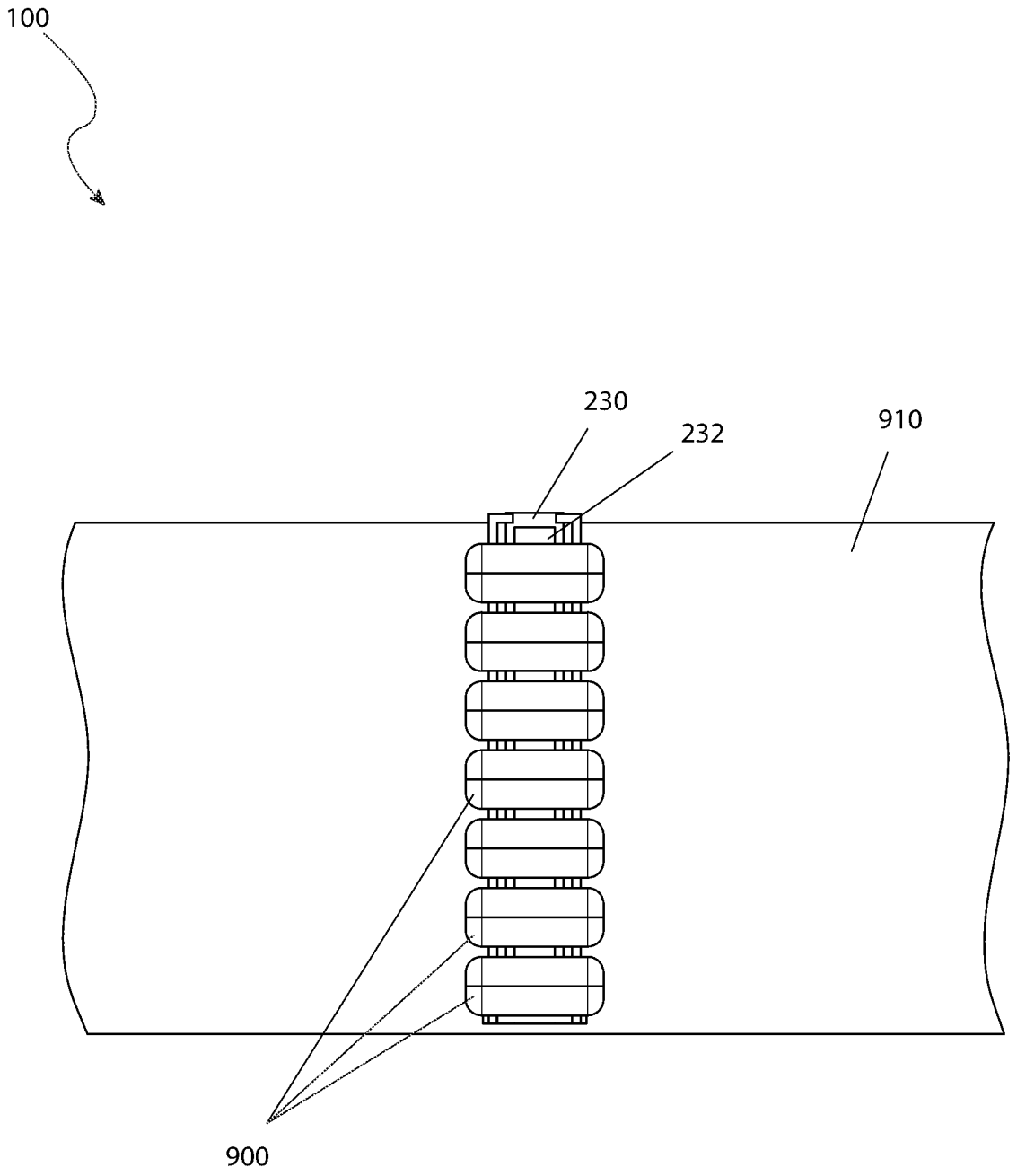
FIG. 6 is a bottom view of a chip rack, according to an embodiment of the present invention.
Figure 7:
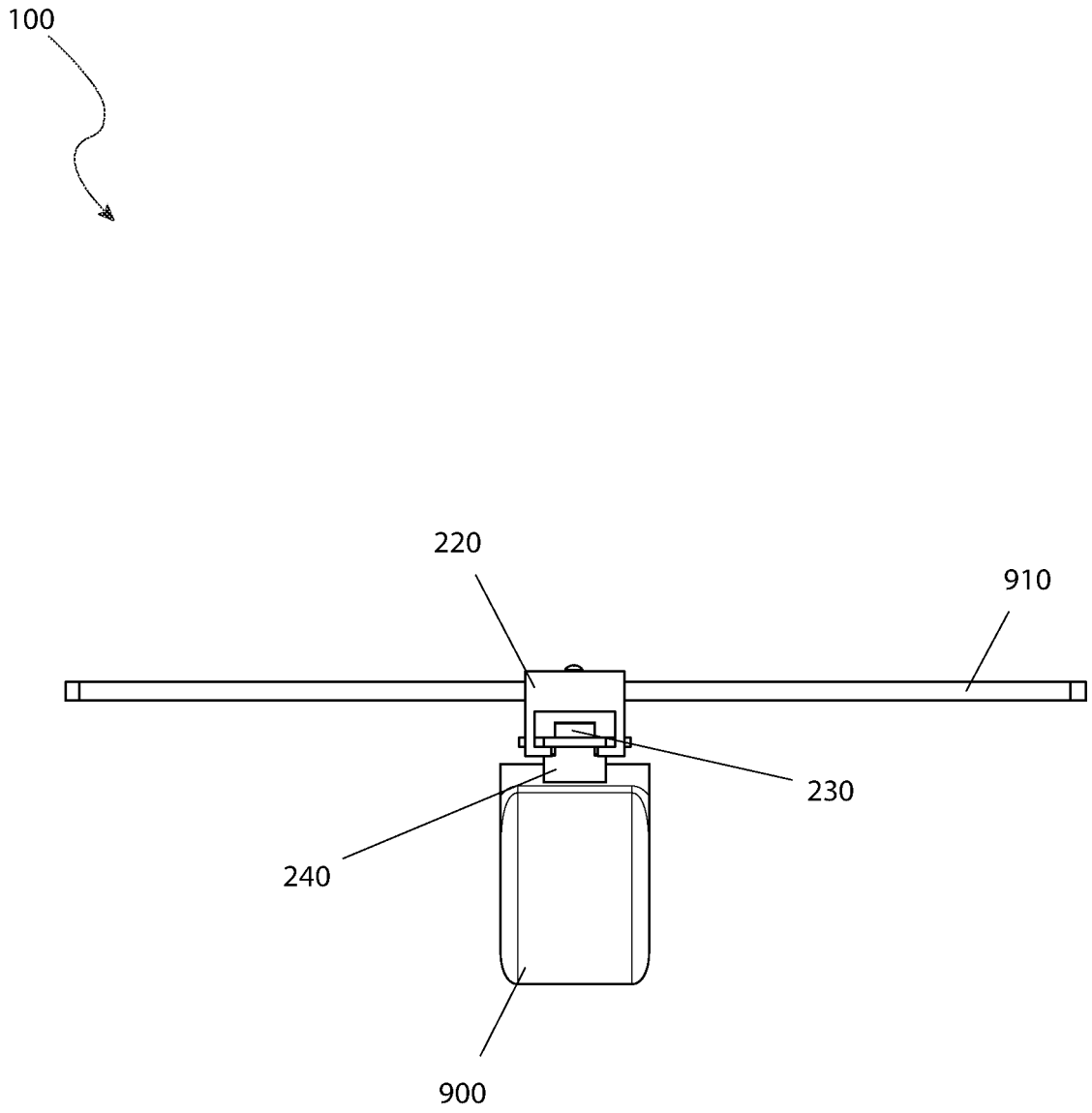
FIG. 7 is a front view of a chip rack, according to an embodiment of the present invention.
Figure 8:
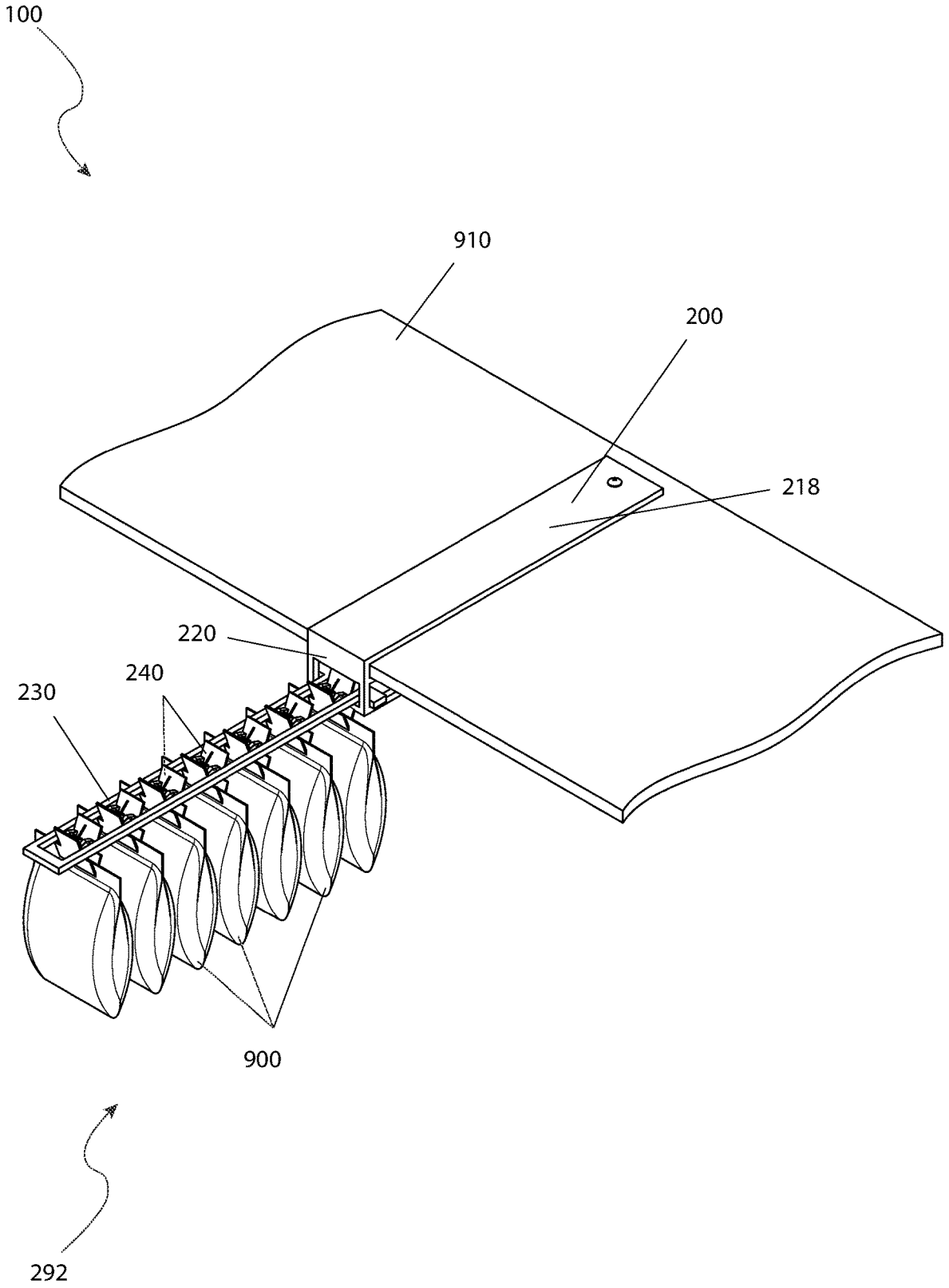
FIG. 8 is a top front isometric view of a chip rack, according to an embodiment of the present invention, illustrating the extended position.
Figure 9:
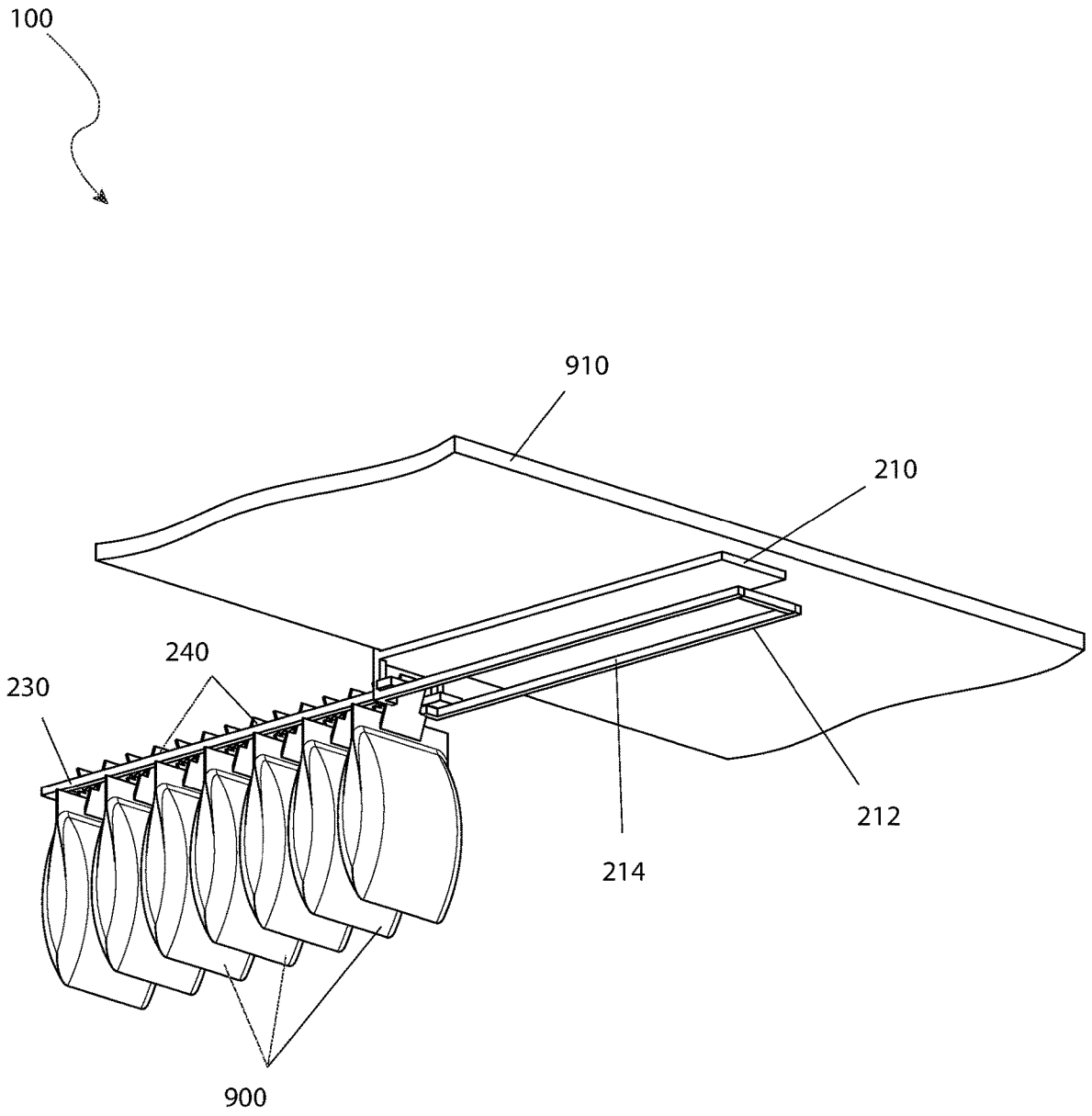
FIG. 9 is a bottom rear isometric view of a chip rack, according to an embodiment of the present invention, illustrating the extended position.
Figure 10:
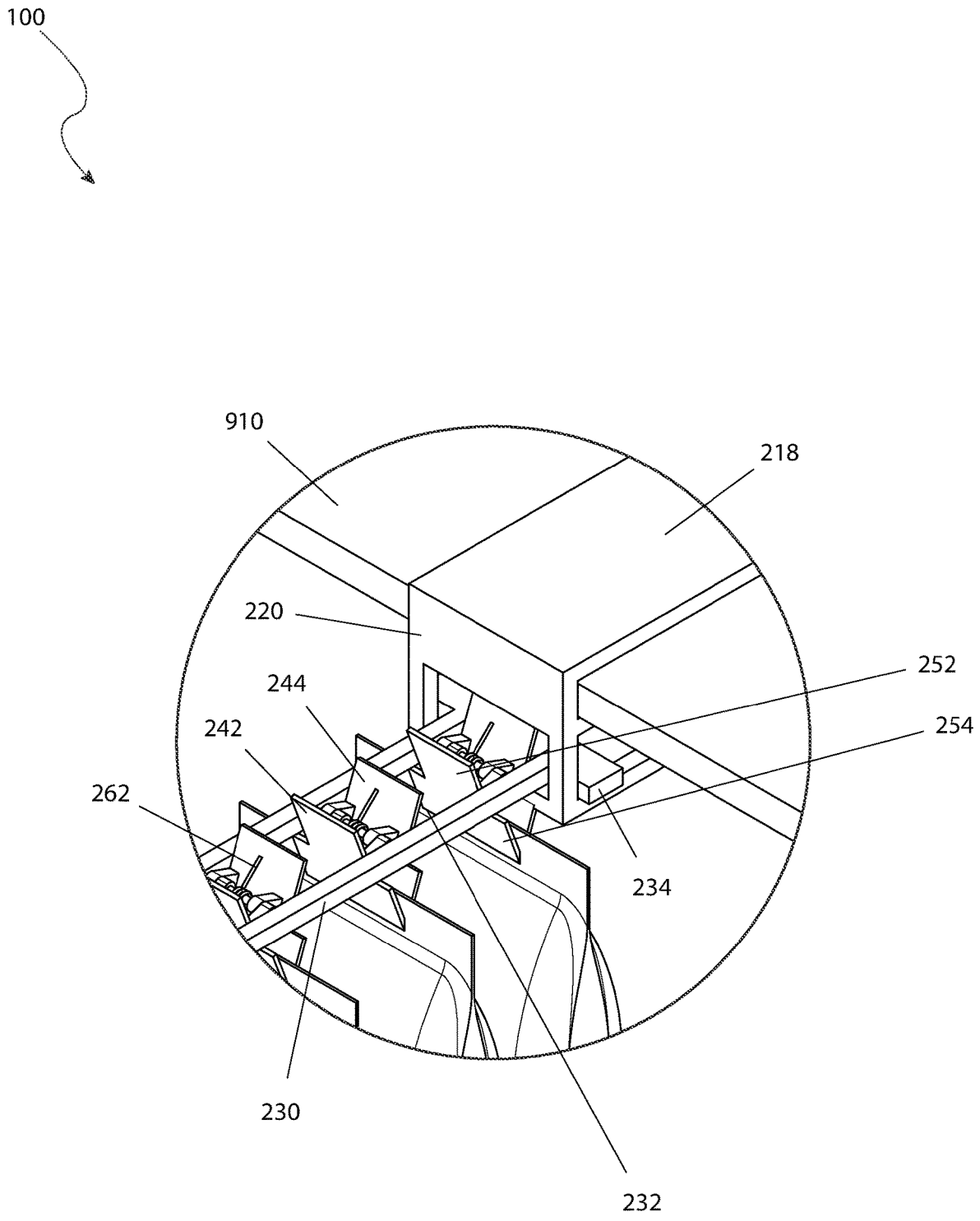
FIG. 10 is a detail view of a chip rack, according to an embodiment of the present invention.

100 chip rack
200 shelf mount
210 undershelf armature
212 slide carrier
214 clip slot
218 overshelf armature
220 end armature
222 clip aperture
230 slide
232 central aperture
234 stopper
240 bag clip
242 front paddle
244 rear paddle
252 paddle top
254 paddle bottom
262 spring
290 retracted position
292 extended position
900 bagged food item
910 shelf

DESCRIPTION OF THE INVENTION

The present invention is directed to a chip rack (herein described as the "invention") 100. The invention 100 may be a storage device for bagged food items 900. The invention 100 may comprise a shelf mount 200 that may couple to a shelf 910, a slide 230 that may extend forward from the shelf mount 200 to provide access to the bagged food items 900, and a plurality of bag clips 240 that may be coupled to the slide 230. The plurality of bag clips 240 may store the bagged food items 900 beneath the slide 230. The plurality of bag clips 240 may hold the bagged food items 900 closed. As non-limiting examples, the bagged food items 900 may comprise one (1) or more bags of potato chips, one (1) or more bags of cereal, one (1) or more bags of crackers, or any combination thereof.

The shelf mount 200 may comprise an undershelf armature 210, a slide carrier 212, and an end armature 220. The shelf mount 200 may couple to the shelf 910 such that the undershelf armature 210 is positioned beneath the shelf 910. The undershelf armature 210 may press against the bottom side of the shelf 910. The slide carrier 212 may be positioned under and parallel to the undershelf armature 210. The end armature 220 may couple the undershelf armature 210 to the slide carrier 212 at the front of the shelf mount 200.

The undershelf armature 210 may be generally rectangular in shape. The front of the undershelf armature 210 may be coupled to the end armature 220. The end armature 220 may extend downward from the undershelf armature 210 and may couple with the front of the slide carrier 212.

The slide carrier 212 may be generally rectangular in shape and may comprise a clip slot 214. The clip slot 214 may be longitudinally oriented on the slide carrier 212 and may open to the front of the slide carrier 212. The slide carrier 212 may guide and retain the slide 230 as the slide 230 moves between a retracted position 290 and an extended position 292. The clip slot 214 may provide clearance for the plurality of bag clips 240 that are coupled to the slide 230 as the plurality of bag clips 240 move through the front of the shelf mount 200.

The end armature 220 may comprise a clip aperture 222 which may provide further clearance for the plurality of bag clips 240.

In some embodiments, the shelf mount 200 may further comprise an overshelf armature 218. The overshelf armature 218 may be generally rectangular in shape. The overshelf armature 218 may press against the top side of the shelf 910. The overshelf armature 218 may be positioned above and parallel to the undershelf armature 210. The end armature 220 may couple the overshelf armature 218 to the undershelf armature 210 and the slide carrier 212 at the front of the shelf mount 200. The overshelf armature 218 and the undershelf armature 210 may grip the shelf 910 in order to support the slide carrier 212.

In some embodiments, mounting hardware may be used to secure the shelf mount 200 to the shelf 910. As a non-limiting example, the mounting hardware may comprise one or more screws.

The slide 230 may be generally rectangular in shape and may comprise a central aperture 232. The slide 230 may be aligned with the slide carrier 212 and may be slidably coupled to the top of the slide carrier 212. The width of the slide 230 may be narrower than the width of the clip aperture 222 such that the slide 230 may move between the retracted position 290 and the extended position 292 by passing through the clip aperture 222. A stopper 234 at the rear of the slide 230 may be wider than the clip aperture 222 to prevent the slide 230 from being removed from the shelf mount 200.

The plurality of bag clips 240 may be coupled to the slide 230 such that the plurality of bag clips 240 pass vertically through the central aperture 232. The plurality of bag clips 240 may be equally spaced along the slide 230 and may be aligned such that each of the plurality of bag clips 240 may be squeezed at the top by applying front to rear pressure.

An individual bag clip selected from the plurality of bag clips 240 may comprise a front paddle 242, a rear paddle 244, and a spring 262. The front paddle 242 may be hingedly coupled to the rear paddle 244. The spring 262 may apply pressure to the front paddle 242 and to the rear paddle 244 causing paddle tops 252 to diverge and paddle bottoms 254 to converge.

The individual bag clip may be operable to hold the bagged food item 900 by squeezing the paddle tops 252 together to overcome the force of the spring 262 and thus separate the paddle bottoms 254, by placing the top of the bagged food item 900 between the paddle bottoms 254, and by releasing the paddle tops 252 such that the spring 262 brings the paddle bottoms 254 together to grasp the bagged food item 900.

In some embodiments, the shelf mount 200 may be made of vinyl-coated metal wire. The vinyl coating may impart a non-slip property to the metal. Alternatively, the shelf mount 200, the slide 230, or any combination thereof may be made of plastic.

In a preferred embodiment, the invention 100 may measure five inches with an error of one inch (5.0+/−1.0 in.) wide and may have a length of ten inches with an error of one inch (10.0+/1.0 inc.) or twenty-two inches with an error of one inch (22/0+/−1.0 in.). In a preferred embodiment, the spacing between the plurality of bag clips 240 may be two to three inches (2.0-3.0 in.).

In use, the shelf mount 200 may be coupled to a shelf 910 such that the slide 230 may be extended out of the front of the shelf mount 200 to the extended position 292. A bagged food item 900 may be placed into an individual bag clip by squeezing the top of the individual bag clip, placing the top of the bagged food item 900 between the front paddle 242 and the rear paddle 244 at the bottom of the individual bag clip, and releasing the top of the individual bag clip. The slide 230 may then be pushed to the retracted position 290 to move the bagged food items 900 under the shelf 910. A bagged food item 900 may similarly be removed from the invention 100 by moving the slide 230 to the extended position 292, squeezing the top of the individual bag clip to release the bagged food item 900, and sliding the slide 230 back to the retracted position 290.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A chip rack for storing bagged food items, comprising:

a shelf mount configured to couple to a shelf, the shelf mount comprising:

an undershelf armature positioned beneath the shelf and configured to press against the bottom side of the shelf;

a slide and a plurality of bag clips coupled to the slide, wherein the bag clips are configured to hold bagged food items closed;

a slide carrier positioned under and parallel to the undershelf armature, the slide carrier comprising a clip slot configured to guide the slide and retain the bag clips; and, an end armature coupled to the undershelf armature and the slide carrier, wherein the end armature comprises an aperture configured to provide clearance for the plurality of bag clips; and, wherein the slide is slidably coupled to the slide carrier and configured to move between a retracted position and an extended position, wherein the slide comprises a stopper at a rear end to prevent the slide from being removed from the shelf mount.

2. The chip rack of claim 1, further comprising: an overshelf armature coupled to a top side of the shelf and configured to press against the top side of the shelf, wherein the overshelf armature is parallel to the undershelf armature to provide support to the slide carrier and grip the shelf between the overshelf armature and the undershelf armature.

3. The chip rack of claim 1, wherein: wherein the slide is configured to extend forward from the shelf mount in the extended position to provide access to bagged food items, and retract into the shelf mount in the retracted position for compact storage; and, wherein the bag clips are configured to pass through a central aperture in the slide, with each clip spaced between two and three inches apart, and each clip is configured to be biased by a spring to maintain a secure hold on the bagged food items.

* * * * *